United States Patent [19]

Kondo

[11] 4,008,147

[45] Feb. 15, 1977

[54] METHOD FOR TREATMENT OF HEAVY FRACTION RECOVERED THROUGH THERMAL CRACKING OF HIGH MOLECULAR-WEIGHT HYDROCARBONACEOUS MATERIALS

[75] Inventor: Masaki Kondo, Tokyo, Japan

[73] Assignee: Sumitomo Shipbuilding & Machinery Co., Ltd., Tokyo, Japan

[22] Filed: Mar. 29, 1974

[21] Appl. No.: 456,145

[30] Foreign Application Priority Data

Apr. 16, 1973 Japan ..... 48-043521

[52] U.S. Cl. ..... 208/126; 196/122; 201/2.5; 208/177; 208/251 R; 208/347

[51] Int. Cl.[2] ..... C10G 9/26; C10G 34/00

[58] Field of Search ..... 208/106, 126, 146, 186, 208/305, 308, 370, 46, 347, 251 R, 177; 201/2.5

[56] References Cited

UNITED STATES PATENTS

| | | | |
|---|---|---|---|
| 1,450,327 | 4/1923 | Smith | 208/126 |
| 1,717,884 | 6/1929 | Knowles | 208/126 |
| 2,380,391 | 7/1945 | Bates | 208/146 |
| 2,561,334 | 7/1951 | Bowles et al. | 208/126 |
| 2,938,852 | 5/1960 | Wolff et al. | 208/126 |

*Primary Examiner*—Herbert Levine
*Attorney, Agent, or Firm*—Woodhams, Blanchard and Flynn

[57] ABSTRACT

A method for treatment of the heavy hydrocarbonaceous fraction resulting from thermal cracking of high molecular-weight hydrocarbonaceous materials, which method comprises removing light hydrocarbons contained in said fraction by bringing it into contact with a bed packed with refractory inorganic particles at an elevated temperature so as to evaporate said light hydrocarbons and regenerating said refractory inorganic particles-packed bed by incinerating heavy hydrocarbonaceous materials remaining on and/or among said particles in the bed by supplying oxygen to the bed.

5 Claims, 1 Drawing Figure

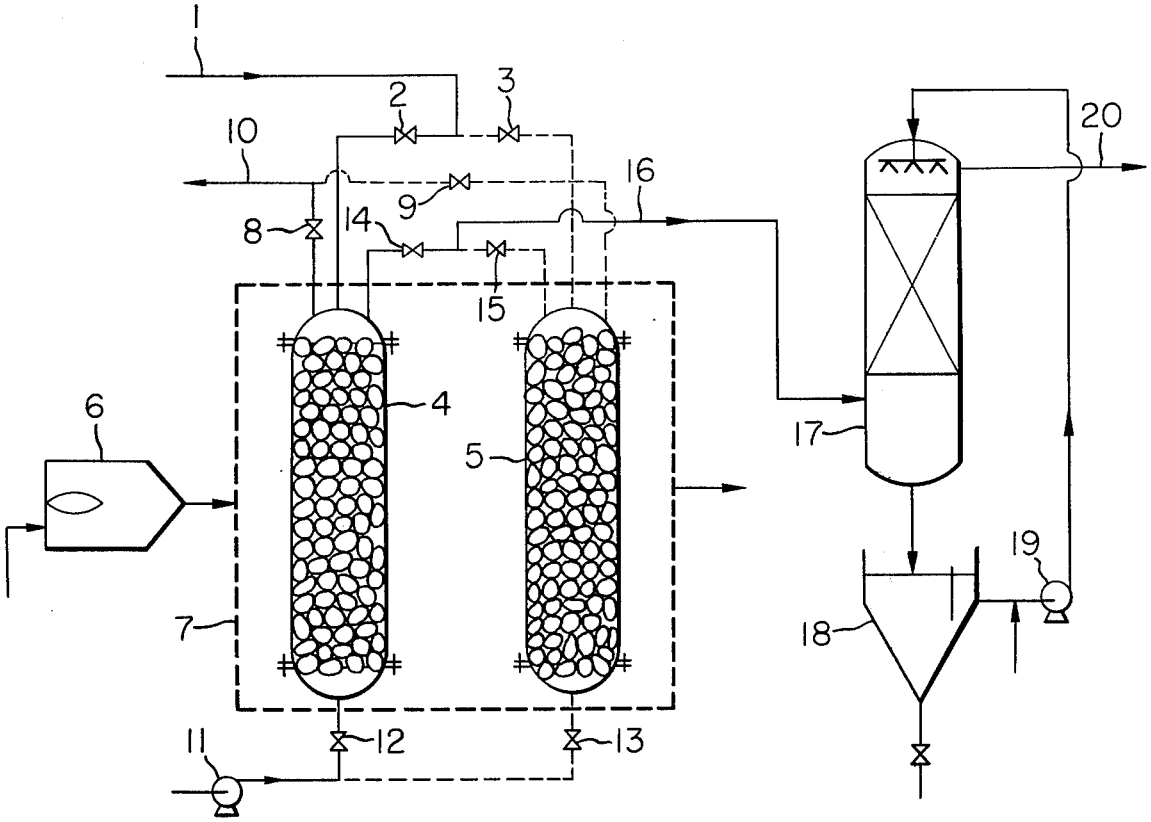
1
2
3
10
16
20
9
8
14
15
6
4
5
17
19
7
18
11
12
13

METHOD FOR TREATMENT OF HEAVY FRACTION RECOVERED THROUGH THERMAL CRACKING OF HIGH MOLECULAR-WEIGHT HYDROCARBONACEOUS MATERIALS

BACKGROUND OF THE INVENTION

The present invention relates to a method for treatment of the heavy fraction resulting from thermal cracking of high molecular-weight hydrocarbonaceous materials — typically, plastics, and it relates particularly to a method capable of effectively separating and removing carbon and other non-evaporable materials contained in said heavy fraction.

As is generally known, in the case of thermal cracking of high molecular-weight hydrocarbonaceous materials like plastics by means of, for instance, a melter-type cracking still, a fluid-bed type cracking furnace or the like, there is produced a heavy fraction containing solid impurities such as carbon and relatively heavy liquid hydrocarbons. Especially in the case of thermal cracking of chlorine-containing plastics and thermosetting plastics, generation of carbon is remarkable. Hydrocarbons contained in the heavy fraction usually become light through the process of re-cracking, but such impurities as carbon and the like contained in the heavy fraction are gradually accumulated within the cracking system unless they are discharged to the outside thereof. According to the prior art, the carbon accumulated within the cracking system is drawn out of the system as occasion demands to be disposed of, but this method is defective in that it cannot sufficiently meet the current public demand for prevention of public nuisances as much as possible.

In the meantime, as a method of separating solids from liquids, the method of separating by filtration is most popular. However, in the case of the foregoing heavy fraction, not only said fraction per se is very viscous but also some of the carbon admixed therewith is in the form of fine particles, so that the conventional method of separating by filtration is ineffective in separating said carbon satisfactorily.

The present invention is intended to provide a method of treating the foregoing heavy fraction which renders it possible to separate said heavy fraction into hydrocarbons and such impurities as carbon and others, and it utilizes the properties of said heavy fraction that carbon and other impurities contained therein do not evaporate at a temperature permitting evaporation of hydrocarbons contained therein.

SUMMARY OF THE INVENTION

The method for treatment of the heavy fraction under the present invention comprises supplying the heavy hydrocarbonaceous fraction resulting from thermal cracking of high molecular-weight hydrocarbonaceous materials to a separation zone having an elevated temperature and packed with refractory inorganic particles, drawing out in the vapor phase, hydrocarbons contained in said heavy hydrocarbonaceous fraction from said separation zone while separating non-evaporable materials contained in said fraction from said vapor-phase hydrocarbons by making them adhere to said refractory inorganic particles, and supplying an oxygen-containing gas to the separation zone polluted with said non-evaporable materials to thereby regenerate said zone.

BRIEF DESCRIPTION OF THE DRAWING

The appended drawing is a schematic representation of one embodiment of the present invention.

DESCRIPTION OF THE PREFERRED EMBODIMENT

The embodiment shown in the appended drawing is the case where a couple of separation zones are employed, but it goes without saying that the method of the present invention can be practiced as well by employing more than two separation zones.

Referring to the appended drawing, the heavy hydrocarbonaceous fraction resulting from thermal cracking of high molecular-weight hydrocarbonaceous materials is supplied to the separation zone 4 through the material supply pipe 1. On this occasion, the valve 2 is opened, while the valve 3 is closed. The separation zone 4 is accommodated in the drum chamber 7 together with the separation zone 5 described below. To this drum chamber 7 is supplied a hot blast (having a temperature of 800°–1000° C) from the hot blast furnace 6, whereby the separation zones 4 and 5 are heated up to a temperature of about 400° C or more. As a result, hydrocarbons contained in the heavy hydrocarbonaceous fraction entering the separation zone 4 evaporate or get thermally cracked to vaporize and then are introduced into the conduit 10 through the valve 8 (on this occasion, the valve 9 is closed). Meanwhile, non-evaporable materials contained in the heavy hydrocarbonaceous fraction, namely, carbon and other impurities, remain on the inner wall of the separation zone and on and/or among refractory inorganic particles packed in said zone. Through the operation as above, hydrocarbons contained in the heavy hydrocarbonaceous fraction are perfectly separated from carbon and other impurities. When the separation zone 4 has been polluted with non-evaporable materials in this way, the valves 2 and 8 are closed while the valves 3 and 9 are opened, whereby the flow of heavy hydrocarbonaceous fraction is directed to the separation zone 5, and in this separation zone 5, the same operation as described above is continued. During the operation in the separation zone 5, regeneration of the separation zone 4 is performed. To be precise, by virtue of the supply of air to the separation zone 4 from the blower 11 upon closing the valves 13 and 15, non-evaporable materials are incinerated. On this occasion, by supplying air slowly, the scattering of dust can be minimized. The gas arising from incineration of non-evaporable materials is introduced into the conduit 16 through the value 14, and is supplied to the gas stripper 17. As this gas arising from incineration is stripped through contact with water being circulated by the pump 19 in said gas stripper 17, even when vaporous cadmium and/or lead are contained in said gas, these metals settle in the waste water tank 18 and are never released into the air. Further, as the gas arising from incineration still contains carbon monoxide after being stripped as above, it can be supplied to the aforementioned hot blast furnace 6 through the conduit 20. Regeneration of the separation zone 4 is completed in this way. Likewise, the separation zone 5 can also be regenerated by properly switching over the valves. And, according to the flow pattern employing at least two separation zones as shown in the appended drawing, treatment of the heavy hydrocarbonaceous fraction and regeneration of the separation zone per se can be performed concurrently in succession.

As will be understood from the above elucidation, according to the method under the present invention, it is possible to not only perfectly separate carbon and other impurities contained in the heavy hydrocarbonaceous fraction without resorting to any particular means of filtration but also perform cracking of hydrocarbons contained in the heavy hydrocarbonaceous fraction again at the time of said separation. Moreover, according to the present invention, such carbon and other impurities separated from the heavy hydrocarbonaceous fraction can be incinerated within the separation zone, so that there is no fear of bringing about any noticeable coking in the separation zone. Besides, because of the refractory inorganic particles packed in the separation zone, the heat capacity of said separation zone is great and the fluctuation of temperature thereof is minor. Accordingly, it has an advantage that the disposal of carbon and other impurities by incineration at the time of regenerating the separation zone can be performed easily and the combustion heat arising from said incineration can be stored till the next separation work. Further, according to the present invention, even when the heavy hydrocarbonaceous fraction contains such heavy metals as cadmium and lead, these heavy metals are separated within the separation zone together with carbon and other impurities, and the thus separated heavy metals evaporate at the time of regeneration of the separation zone and can be collected by means of a subsequent gas stripper so that there is no fear of environmental pollution due to these heavy metals.

What is claimed is:

1. A method for treating the heavy liquid fraction comprising evaporable liquid hydrocarbons and non-evaporable materials obtained by thermal cracking of high molecular weight hydrocarbonaceous materials, which consists essentially of the steps of: feeding a stream of said heavy fraction into a vessel packed with a stationary bed of refractory inorganic particles and simultaneously externally heating said bed at an elevated temperature effective to vaporize said evaporable liquid hydrocarbons and to leave said non-evaporable materials deposited on said particles, and removing the vapor of said evaporable hydrocarbons from said vessel; discontinuing the feed of said heavy fraction when said bed contains sufficient deposited non-evaporable materials so as to require regeneration; then feeding molecular oxygen-containing gas into said vessel while continuing to externally heat said bed of refractory inorganic particles at said elevated temperature to incinerate said non-evaporable materials and to regenerate said refractory inorganic particles, and removing the gaseous products of the incineration from said vessel.

2. A method according to claim 1, in which said gaseous products of the incineration are flowed into scrubber column means and therein contacting same with water to separate same into a gaseous fraction and a waste water fraction.

3. A method according to claim 1 in which there are provided at least two vessels containing stationary beds of refractory inorganic particles, and including the steps of feeding said stream of said heavy fraction alternately to said vessels and while the stream is being fed to one vessel, regenerating the bed of refractory inorganic particles in the other vessel.

4. A method according to claim 3 in which said vessels are disposed in a common enclosure, and including the step of feeding hot gas into said enclosure to simultaneously externally heat said vessels to said elevated temperature.

5. A method according to claim 3 in which said vessels are externally heated to a temperature of at least about 400° C.

* * * * *